US012551744B2

(12) United States Patent
Dixon et al.

(10) Patent No.: US 12,551,744 B2
(45) Date of Patent: Feb. 17, 2026

(54) METHOD, APPARATUS, AND SYSTEM FOR MOTORIZED REHABILITATIVE CYCLING

(71) Applicant: UNIVERSITY OF FLORIDA RESEARCH FOUNDATION, INCORPORATED, Gainesville, FL (US)

(72) Inventors: Warren E. Dixon, Gainesville, FL (US); Kimberly J. Stubbs, Gainesville, FL (US); Emily J. Griffis, Gainesville, FL (US); Wanjiku A. Makumi, Gainesville, FL (US); Hannah M. Sweatland, Gainesville, FL (US); Tanja Taivassalo, Gainesville, FL (US); Donovan Lott, Gainesville, FL (US)

(73) Assignee: UNIVERSITY OF FLORIDA RESEARCH FOUNDATION, INCORPORATED, Gainesville, FL (US)

( * ) Notice: Subject to any disclaimer, the term of this patent is extended or adjusted under 35 U.S.C. 154(b) by 187 days.

(21) Appl. No.: 18/361,276

(22) Filed: Jul. 28, 2023

(65) Prior Publication Data

US 2024/0042260 A1 Feb. 8, 2024

Related U.S. Application Data

(60) Provisional application No. 63/370,450, filed on Aug. 4, 2022.

(51) Int. Cl.
*A63B 21/005* (2006.01)
*A63B 22/06* (2006.01)
(Continued)

(52) U.S. Cl.
CPC ..... *A63B 21/0058* (2013.01); *A63B 22/0605* (2013.01); *A63B 24/0062* (2013.01);
(Continued)

(58) Field of Classification Search
CPC ..... A63B 21/0058; A63B 22/0605; A63B 24/0062; A63B 71/0622;
(Continued)

(56) References Cited

U.S. PATENT DOCUMENTS 9,265,685 B1 * 2/2016 McAmis ..... A63B 21/4035
12,029,940 B2 * 7/2024 Hacking ..... A63B 21/00072
(Continued)

*Primary Examiner* — Sundhara M Ganesan
(74) *Attorney, Agent, or Firm* — ALSTON & BIRD LLP

(57) ABSTRACT

Provided herein is a method, apparatus, and system a motor-assisted stationary rehabilitation cycle employing a closed-loop control scheme. Methods may include: determining a desired set point rotational speed of a pair of pedals connected to a crankshaft; determining an upper bound and a lower bound about the desired set point rotational speed; determining a crankshaft rotational speed; increasing torque using a motor connected, at least indirectly, to the crankshaft in a first rotational direction, resisting rotation of the crankshaft in response to the rotational speed of the crankshaft approaching the upper bound; and increasing torque using the motor in a second rotational direction, opposite the first rotational direction in response to the rotational speed of the crankshaft approaching the lower bound.

19 Claims, 7 Drawing Sheets

(51) Int. Cl.
*A63B 24/00* (2006.01)
*A63B 71/06* (2006.01)

(52) U.S. Cl.
CPC .. *A63B 71/0622* (2013.01); *A63B 2024/0093* (2013.01); *A63B 2220/30* (2013.01); *A63B 2220/54* (2013.01)

(58) Field of Classification Search
CPC ..... A63B 2024/0093; A63B 2220/30; A63B 2220/54; A63B 2022/0094
See application file for complete search history.

(56) References Cited

U.S. PATENT DOCUMENTS

| | | | | |
|---|---|---|---|---|
| 2020/0269092 | A1* | 8/2020 | Radow | A63B 21/0056 |
| 2020/0289880 | A1* | 9/2020 | Hacking | A63B 21/154 |
| 2020/0289881 | A1* | 9/2020 | Hacking | G16H 20/30 |
| 2020/0289889 | A1* | 9/2020 | Hacking | A63B 21/4034 |
| 2020/0360761 | A1* | 11/2020 | Bissonnette | A63B 21/015 |
| 2021/0134457 | A1* | 5/2021 | Mason | A61B 5/7267 |
| 2021/0138304 | A1* | 5/2021 | Mason | A63B 24/0075 |
| 2022/0047921 | A1* | 2/2022 | Bissonnette | A63B 71/0622 |
| 2022/0118315 | A1* | 4/2022 | Sankai | A61B 5/222 |
| 2022/0126169 | A1* | 4/2022 | Mason | A63B 24/0062 |
| 2023/0381592 | A1* | 11/2023 | Ellzey | A63B 71/0622 |

* cited by examiner

Algorithm 1 Pseudocode of control scheme.

Let $u$ denote the designed motor control input.

1. *while* $\dot{q} < \dot{q}_d$, $u = C$,
   where $C$ denotes a constant (i.e., ramp-up period of constant motor assistance until the rider's cadence $\dot{q}$ reaches the desired cadence $\dot{q}_d$).

2. *if* the rider's cadence approaches the lower bound of the cadence range (i.e., $\dot{q} \rightarrow \dot{q}_d - \Delta_d$)

The motor control input $u$ increases to provide assistance to the rider and keep the rider's cadence within the bounds.

*else if* the rider's cadence approaches the upper bound of the cadence range (i.e., $\dot{q} \rightarrow \dot{q}_d + \Delta_d$)

The motor control input $u$ resists the rider to keep the rider's cadence within the bounds.

*else*

The rider tracks the admittance trajectory, a trajectory which allows for indirect torque tracking through an admittance filter. The admittance trajectory will be determined based on a desired system, the parameters of which are set by the admittance filter.

FIG. 5

METHOD, APPARATUS, AND SYSTEM FOR MOTORIZED REHABILITATIVE CYCLING

CROSS-REFERENCE TO RELATED APPLICATIONS

This application claims priority to U.S. Provisional Patent Application Ser. No. 63/370,450, filed on Aug. 4, 2022, the contents of which are hereby incorporated by reference in their entirety.

STATEMENT OF GOVERNMENT FUNDING

This invention was made with government support under W81XWH1910330 awarded by U.S. ARMY MEDICAL RESEARCH ACQUISITION. The government has certain rights in the invention.

TECHNOLOGICAL FIELD

An example embodiment of the present disclosure relates to a method, apparatus, and system for rehabilitative cycling, and more particularly, to a motor-assisted stationary rehabilitation cycle employing a closed-loop control scheme.

BACKGROUND

Duchenne muscular dystrophy (DMD) is a rapidly progressive, genetic muscle disease primarily affecting males that causes a steady degeneration of muscle fibers and leads to loss of muscle strength, endurance and functional abilities. Boys with DMD experience difficulty in movement, loss of limb function, and eventually the need for assisted breathing. Most individuals with DMD lose the ability to walk at approximately 10-12 years of age with subsequent deterioration of arm function, followed by cardiac and respiratory muscle dysfunction leading to death typically in their twenties. Given this devastating disease course, delaying loss of muscle degeneration and functional capabilities is imperative for both management of DMD and improvement of overall quality of life. Exercise has been proposed to delay these losses; however, high-intensity and eccentric muscle contractions have shown to increase muscle damage in this disease and should be avoided by boys with DMD. Existing physical rehabilitative strategies focus on aerobic and low-to-moderate intensity strengthening exercises, showing potential benefit and ability to delay the loss of limb function. Rehabilitative cycling can have a positive effect on DMD to help maintain lower limb functionality and reducing degradation of muscle fibers.

BRIEF SUMMARY

Embodiments of the present disclosure provide a method, apparatus, and system for a motor-assisted stationary rehabilitation cycle employing a closed-loop control scheme. Embodiments provided herein include a system that includes: a pair of pedals connected to a crankshaft via a pair of pedal arms; a motor coupled directly or indirectly to the crankshaft; and a controller configured to control the motor, during steady-state operation, to increase torque in a first rotational direction, resisting rotation of the crankshaft in response to a rotational speed of the crankshaft approaching a first predefined rotational speed, which may include a prescribed upper bound on the cadence, and increase torque in a second rotational direction, opposite the first rotational direction, in response to the rotational speed of the crankshaft approaching a second predefined rotational speed, which may include a lower cadence bound. The controller of example embodiments described herein operates as a closed-loop adaptive admittance controller for the motor. Embodiments of the system optionally include a display, where the display provides for display of the first predefined rotational speed, the second predefined rotational speed, and the rotational speed of the crankshaft.

According to some embodiments, the controller implements a control barrier function to increase torque in the first rotational direction, resisting rotation of the crankshaft in response to the rotational speed of the crankshaft approaching the first predefined rotational speed, and increase torque in the second rotational direction, opposite the first rotational direction (e.g., assisting with pedaling input) in response to the rotational speed of the crankshaft approaching the second predefined rotational speed. The controller of an example embodiment is configured to encourage volitional pedaling while ensuring safety by constraining a cadence of a participant operating the pair of pedals by constraining the rotational speed of the crankshaft between the first rotational speed and the second rotational speed. Embodiments of the system optionally include a seat that is adjustable relative to the pair of pedals to accommodate participants of differing sizes. The pair of pedal arms extend between the crankshaft and the pair of pedals, where the pedal arms of an example embodiment include an adjustable length to change the pedal stroke about the crankshaft. The controller of an example embodiment is configured to track torque of a desired torque through use of an admittance filter. Steady-state operation of an example embodiment is achieved in response to the rotational speed of the crankshaft rising from zero to be above the second predefined rotational speed. According to some embodiments, a transient operation occurs before steady-state operation, where during transient operation, the controller is configured to control the motor to increase torque in the second rotational direction until the second predefined rotational speed is achieved.

Embodiments provided herein include a method including: determining a desired set point rotational speed of a pair of pedals connected to a crankshaft; determining an upper bound and a lower bound about the desired set point rotational speed; determining a crankshaft rotational speed; increasing torque using a motor connected, at least indirectly, to the crankshaft in a first rotational direction, resisting rotation of the crankshaft in response to the rotational speed of the crankshaft approaching the upper bound; and increasing torque using the motor in a second rotational direction, opposite the first rotational direction in response to the rotational speed of the crankshaft approaching the lower bound.

According to some embodiments, the method includes providing for display of the desired set point rotational speed, the upper bound, the lower bound, and the rotational speed of the crankshaft. The method of an example embodiment further includes encouraging volitional pedaling while constraining a cadence of a participant operating a pair of pedals by constraining the rotational speed of the crankshaft between the first rotational speed and the second rotational speed. The method of an example embodiment further includes tracking torque of a desired torque through an admittance filter.

Embodiments provided herein include a controller, the controller configured to: receive a desired set point rotational speed of a pair of pedals connected to a crankshaft; receive an upper bound and a lower bound about the desired set point rotational speed; determine a crankshaft rotational speed; increase torque using a motor connected, at least indirectly, to the crankshaft in a first rotational direction, resisting rotation of the crankshaft in response to the rotational speed of the crankshaft approaching the upper bound; and increase torque using the motor in a second rotational direction, opposite the first rotational direction in response to the rotational speed of the crankshaft approaching the lower bound. The controller of an example embodiment operates in a closed-loop manner to control torque of the motor. The controller of an example embodiment is further configured to track torque received at the crankshaft through an admittance filter. The controller of an example embodiment is further configured to provide for display of the desired set point rotational speed, the upper bound, the lower bound, and the rotational speed of the crankshaft.

BRIEF DESCRIPTION OF DRAWINGS

FIG. 5 illustrates an algorithm for pseudocode of a control scheme according to an example embodiment of the present disclosure;

DETAILED DESCRIPTION

Figure 1:
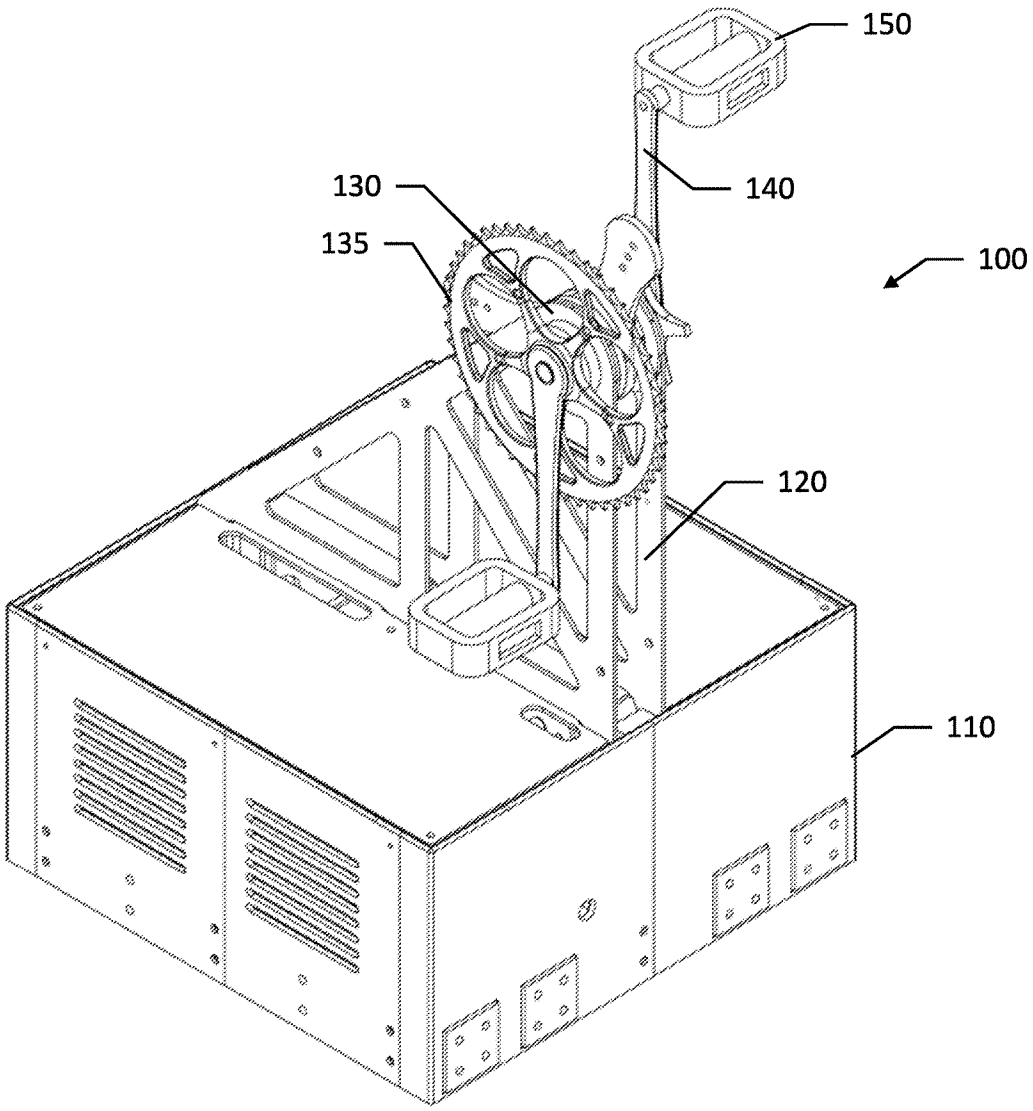
FIG. 1 illustrates a cycling box for a rehabilitation robot for recumbent cycling according to an embodiment of the present disclosure.

Some example embodiments of the present disclosure will now be described more fully hereinafter with reference to the accompanying drawings, in which some, but not all embodiments of the invention are shown. Indeed, various embodiments of the disclosure may be embodied in many different forms and should not be construed as limited to the example embodiments set forth herein; rather, these example embodiments are provided so that this disclosure will satisfy applicable legal requirements. Like reference numerals refer to like elements throughout.

Duchenne muscular dystrophy (DMD) is a severe, rapidly progressive muscle-wasting disease that affects thousands of individuals. DMD leads to difficulty in movement, loss of limb function, and eventually the need for assisted breathing. Exercise, such as rehabilitative cycling, can be used to counter these losses. Rehabilitative cycling performed with an appropriate muscle overload may induce physiological adaptation and improve muscle endurance, strength and function in DMD. Lack of a commercially available or engineered rehabilitation cycle with closed-loop control has prevented the scientific community from understanding the possible benefits of exercise for this patient population.

Rehabilitative motor-assisted cycling can potentially delay loss of functional abilities in individuals with DMD. However, prior motor-assisted cycling for DMD participants employs only open-loop control schemes. Embodiments described herein provide a motor-assisted stationary rehabilitation cycle developed for DMD participants. A dual-objective control scheme is developed for the motor control input of the rehabilitative device provided herein. Embodiments of the present disclosure provide a control barrier function (CBF) configured to restrict the cadence of the rider within a user-defined desired cadence range to maximize rehabilitative efforts. A closed-loop adaptive admittance control scheme is developed to provide indirect torque tracking while the cadence of the rider is within the desired region. A Lyapunov-like stability analysis is used to ensure asymptotic tracking of the admittance errors within the desired cadence range and uniform global asymptotic stability of the safe set. Embodiments provide an efficient mechanical system and control method that can yield a root mean squared error of 1.482 RPM of the admitted cadence tracking objective.

Rehabilitative cycling is a safe and feasible functional treatment that can be widely applied, regardless of the severity of motor impairment. Application of both upper and lower extremity motor-assisted cycling for DMD participants has theoretical potential to improve functional abilities and delay in loss of function. Embodiments provided herein include a control scheme for a rehabilitation robot for individuals with DMD that adapts to the functional abilities of each participant rather than requiring a participant to adhere to a uniform predefined strategy such as a constant cycling cadence objective. Admittance control is a control strategy capable of modifying system behavior on force-feedback and promotes safety over performance by resolving conflicts in motion during human-system interaction. Admittance control also provides an intuitive method for rehabilitation robots to safely interact with humans without forcing them to adhere to predefined trajectories.

Embodiments provided herein employ a constructive Lyapunov-based analysis with a control barrier function (CBF) approach. CBF-based control ensures safety of the developed control scheme and uses an optimization approach to determine the controller with the minimum required effort that satisfies the safety criteria. CBFs can be used to design controllers that render sets of states forward invariant, i.e., any trajectory that begins within a pre-defined safe region remains in that region for all time. CBFs as employed herein restrict the cadence of the rider within a user-defined range about a desired midpoint. Restriction of the rider's cadence about an operator-defined set point encourages volitional pedaling of the rider while satisfying the developed safety criteria. By appropriately selecting parameters in the admittance filter, the admittance system can be made increasingly stiff or compliant through varying motor input to assist the rider as needed. A Lyapunov-like stability analysis ensures uniform global asymptotic stability of the safe set and asymptotic tracking of the admittance errors.

Embodiments provided herein include a motor-assisted stationary cycle developed for rehabilitative efforts for people with DMD. The aim of the recumbent cycle described herein is to provide long-term (6 months or more), at-home lower-limb rehabilitation. Challenges include scaling a size of the cycle for child participants, a variability in sizes between participants, and accommodations for at-home rehabilitation with remote clinical access. Requiring a participant to travel to a clinical-setting physician to receive frequent, routine rehabilitation cycling sessions is not feasible as DMD requires specialized care, and a knowledgeable clinician may not be reasonably close to facilitate such in-person visits. Further, rehabilitation settings may not have the appropriate equipment to suit the limitations of individuals with DMD. For example, the individual's muscles may be too weak to overcome inertia and load of unassisted cycling on commercialized recumbent bicycles. For these reasons, a rehabilitation robot is provided that is capable of being used inside a participant's home rather than in a clinician's office with individualized assistance necessary to make DMD rehabilitation feasible. Embodiments provided herein include a mechanical system that enables a clinician to video chat with the participant and/or a guardian and remotely access a controller of the robot cycle for the duration of the exercise regimen.

DMD typically affects young boys, such that development of a rehabilitative recumbent cycle for individuals with DMD is challenging with a target age of participants being around six to ten years of age, which is when most individuals with DMD still have ambulatory function. Hence, a significant majority of commercially available exercise machines cannot be used in conjunction with embodiments described herein due to size and load limitations. Further, commercially available exercise cycles are not designed for rehabilitation and are not compatible with a rehabilitative robot of example embodiments. Embodiments described herein ensure the recumbent cycle is capable of adapting to the variability of heights among participants and the growth of the participant over the duration of use. Embodiments employ crank arms with adjustable length and adjustable attachments to a participant's chair to accommodate height ranges of participants within the target age range. These adjustable features allow for the participant to pedal without full extension of the knee or excess knee flexion. The participant can be harnessed into a seat of the cycle to prevent excess movement of the participant.

FIG. 1 illustrates an example embodiment of a rehabilitation robot 100 for recumbent cycling as described herein. The rehabilitation robot 100 includes a base 110 that houses electrical components. The rehabilitation robot 100 may include a frame of a rigid material, such as aluminum with one or more uprights 120 to support the crankshaft assembly 130 to the base 110. Crank arms 140 can be adjustable in length to help account for variation in sizes between participants. The pedals 150 can include a device to secure the feet of a participant to the pedals, such as Velcro® straps, pedal clips, toe cups, etc. A chain can (not shown) can rotatably connect the sprocket 135 of the crankshaft assembly 130 to a sprocket on a shaft of the motor within the rehabilitation robot 100 base 110. A sprocket or chain guard can be provided to protect a participant from the rotating components during use. An encoder can be used within the base 110 or attached to the uprights 120 to measure crank angle of the sprocket 135 and pedals 150.

According to some embodiments, motor control is implemented using a motor driver and power assembly. Torque measurements about the crankshaft can be recorded using a torque sensor, with position and cadence about the crankshaft measured using digital encoders. An onboard data acquisition board can measure the encoder signal. The system can include an onboard computer or processing circuitry, or employ a controller implemented via software on an externally located computer. An emergency cut-off switch can also be included to ensure participant safety.

A rider pedaling the recumbent stationary cycle of example embodiments described herein can be modeled as a single degree-of-freedom system:

$$M(q)\ddot{q} + \frac{1}{2}\dot{M}(q, \dot{q})\dot{q} + P(q, \dot{q}) + G(q) + b_c\dot{q} + d(t) = \tau_c(t) + \tau_{vol}(t) \quad \text{Eq. 1}$$

where $q(t): \mathbb{R}_{\geq 0} \rightarrow \mathcal{Q}$, $\dot{q}(t): \mathbb{R}_{\geq 0} \rightarrow \mathbb{R}$, and $\mathbb{R}_{\geq 0} \rightarrow \mathbb{R}$ denote the angular position, velocity, and acceleration of the crank angle, respectively, and $\mathcal{Q} \subset \mathbb{R}$ denotes the set of possible crank angles. Unknown passive elastic effects and gravitational effects of the combined rider-cycle system are denoted by $P: \mathcal{Q} \times \mathbb{R} \rightarrow \mathbb{R}$ and $G: \mathcal{Q} \rightarrow \mathbb{R}$, respectively. Damping in the cycle is denoted by $b_c \in \mathbb{R}_{>0}$. The combined rider and cycle inertial effects $M: \mathcal{Q} \rightarrow \mathbb{R}$ can be modeled as $M(q)=M_r(q)+M_c(q)$, where $M_r$, $M_c: \mathcal{Q} \rightarrow \mathbb{R}$ denote the inertia of the rider and the cycle, respectively. Unmodeled bounded disturbances (e.g., fatigue, signal and response delays, spasms, changing muscle geometry) and torque produced by the rider due to volitional pedaling are denoted by $d: \mathbb{R}_{\geq 0} \rightarrow \mathbb{R}$ and $\tau_{vol}: \mathbb{R}_{\geq 0} \rightarrow \mathbb{R}$, respectively. The torque about the crank axis provided by an electric motor $\tau_c: \mathbb{R}_{\geq 0} \rightarrow \mathbb{R}$ can be modeled as:

$$\tau_c(t) = g_e u_e(t) \quad \text{Eq. 2}$$

where $\tau_c \in \mathbb{R}_{>0}$ is a known constant relating the current in the electric motor to the resulting torque about the crank axis, and $u_e: \mathbb{R}_{\geq 0} \rightarrow \mathbb{R}$ denotes the input current applied to the motor.

The following properties and assumptions facilitate the subsequent analysis.

Property 1. The moment of inertia M can be bounded as $c_m \leq M \leq c_M$, $\forall_q \in \mathcal{Q}$ where $c_m, c_M \in \mathbb{R}_{>0}$ are known constants.

Property 2. The first time derivative of the moment of inertia $\dot{M}$ can be bounded as $$\left|\frac{1}{2}\dot{M}\right| \leq c_v|\dot{q}|, \forall_q \in \mathcal{Q}$$

and $\forall_{\dot{q}} \in \mathbb{R}$, where $c_v \in \mathbb{R}_{>0}$ is a known constant.

Property 3. The damping in the cycle $b_c$ can be bounded as $0 < b_c < c_B$, where $c_B \in \mathbb{R}_{>0}$ is a known constant.

Property 4. The gravitational effects G can be bounded as $|G(q(t)| \leq c_G$, $\forall_q \in \mathcal{Q}$ where $c_G \in \mathbb{R}_{>0}$ is a known constant.

Property 5. The passive elastic effects can be bounded as $|P(q(t), \dot{q}(t))| \leq c_{P1} + c_{P2}|\dot{q}(t)|$, $\forall_q \in \mathcal{Q}$ and $\forall_{\dot{q}} \in \mathbb{R}$, where $c_{P1}, c_{P2} \in \mathbb{R}_{>0}$ are known constants.

Property 6. The uncertain terms M, G, and $b_c$ are linear in the parameters.

Assumption 1. The torque generated by system disturbances d, is upper-bounded by $|d| \leq c_d$, where $c_d \in \mathbb{R}_{>0}$ is a known constant.

Assumption 2. Due to physical limitations of the rider, the volitional muscle torque $\tau_{vol}$ is upper-bounded by $|\tau_{vol}| \leq c_{vol}$, where $c_{vol} \in \mathbb{R}_{>0}$ is a known constant.

The primary control objective of example embodiments described herein is to restrict the cadence of the cycle within a safe operating range while enabling indirect torque tracking within the selected range through an admittance filter. Specifically, a CBF is developed to restrict the cadence of the rider about a user-selected set point, and a closed-loop adaptive admittance controller is developed for when the cadence of the rider is within the safe set. Subsequently defined control gains allow a clinician to adjust the cadence and difficulty of pedaling the cycle system based on the functional abilities and heart rate of the rider.

To quantify the objective of restricting the rider's cadence within a user-defined range about a constant midpoint, the cadence tracking error signal e: $\mathbb{R}_{\geq 0} \rightarrow \mathbb{R}$ is defined as:

$$e \triangleq \dot{q}_d - \dot{q} \quad \text{Eq. 3}$$

where $\dot{q}_d \in \mathbb{R}_{>0}$ denotes the user-selected midpoint of the desired cadence range. The user-selected desired cadence range $\Delta_d \in \mathbb{R}_{>0}$ is defined such that the goal of the control objective is to restrict the cadence of the rider so that $\dot{q} \in [\dot{q}_d - \Delta_d, \dot{q}_d + \Delta_d]$. Based on subsequent analysis, a barrier function candidate B: $\mathcal{Q} \times \mathbb{R} \rightarrow \mathbb{R}$ is defined as:

$$B(z) \triangleq \frac{1}{2} M(q)\left[e^2 - \Delta_d^2\right] \quad \text{Eq. 4}$$

with the safe set:

$$\mathbb{S} = \{z \in \mathcal{Q} \times \mathbb{R} : |e| \leq \Delta_d\} = \mathbb{R} \times [\dot{q}_d - \Delta_d, \dot{q}_d + \Delta_d] \quad \text{Eq. 5}$$

To ensure the safe set $\mathbb{S}$ uniformly globally asymptotically stable (UGAS), the motor control input must be constrained such that the barrier function candidate B(z) acts like a Lyapunov function outside of the set $\mathbb{S}$. This, and the subsequent stability analysis, motivates that the motor control input $u_e$ be constrained from the mapping:

$$\mathcal{U}(z) \triangleq \{ u_e \in \mathbb{R} : \dot{B}(z) \leq -\gamma \} \quad \text{Eq. 6}$$

where $\gamma$ is a constraining function defined to be positive outside of the safe set. Based on the subsequent analysis, $\gamma \triangleq K_M(e^2 - \Delta_d^2)$, where $K_M \in \mathbb{R}_{>0}$ denotes a user-selected control gain. Uncertainties in the model dynamics prevent direct computation of the constraint defining $\mathcal{U}$. To compensate for the model uncertainties, Lyapunov-like robust control techniques can be implemented to create upper bounds of unknown terms in $\dot{B}(z)$ for the subsequent control development and analysis.

Taking the time derivative of Eq. 4, substituting Eq. 1-3, and canceling like terms yields:

$$\dot{B}(z) = -\frac{1}{2}\dot{M}(q, \dot{q})\Delta_d^2 + M(q)e\ddot{q}_d - e\left(g_e \mathcal{U}_e + \tau_{vol}\right) - e(P(q, \dot{q}) + G(q)) - e\left(\frac{1}{2}\dot{M}(q, \dot{q})\dot{q}_d + b_c\dot{q} + d(t)\right) \quad \text{Eq. 7}$$

By Properties 1-5 and Assumptions 1-2, Eq. 7 can be upper-bounded as:

$$\dot{B}(z) \leq -eg_e\, \mathcal{U}_e + C_1 + C_2|e| + C_3 e^2 \quad \text{Eq. 8}$$

where $C_1, C_2, C_3 \in \mathbb{R}_{>0}$ are known constants. Based on the subsequent control development and stability analysis, the function $K_u$: $\mathbb{R} \rightarrow \mathbb{R}$ is defined as $K_u(e) \triangleq K_1 + K_2|e| + K_3 e^2$, where $K_1, K_2, K_3 \in \mathbb{R}_{>0}$ denote user-selected control gains with control conditions such that:

$$K_i \geq C_i, \ \forall i \in [1,2,3] \quad \text{Eq. 9}$$

From the gain conditions in Eq. 9, the inequality in Eq. 8 can be further upper-bounded as:

$$\dot{B}(z) \leq -eg_e\, \mathcal{U}_e + K_u(e) \quad \text{Eq. 10}$$

Substituting Eq. 10 into Eq. 6 yields the input constrained set:

$$\mathcal{U}(z) \triangleq \{ u_e \in \mathbb{R} : -eg_e\, \mathcal{U}_e + K_u(e) \leq -K_M(e^2 - \Delta_d^2) \} \quad \text{Eq. 11}$$

From Eq. 11, the implementable form of the control input is defined as:

$$\mathcal{U}^*_e(e) \triangleq \arg\min |u_e - u_{nom}|^2, \ s.t. -eg_e\, \mathcal{U}_e + K_u(e) + K_M(e^2 - \Delta_d^2) \leq 0 \quad \text{Eq. 12}$$

where $\mathcal{U}^*_e \in \mathbb{R}$ denotes the minimum allowable control input, and $u_{nom} \in \mathbb{R}$ denotes the subsequently designed admittance controller. Using the solution for the minimum motor control input $\mathcal{U}^*_e$ in Eq. 12 can be expressed as:

$$u_e^* = \begin{cases} \dfrac{K_u(e) + K_M(e^2 - \Delta_d^2)}{eg_e} & a(e) > 0 \\ u_{nom} & \text{else,} \end{cases} \quad \text{Eq. 13}$$

Where $a(e) \triangleq -eg_e\, \mathcal{U}_{nom} + K_u(e) + K_M(e^2 - \Delta_d^2)$. To eliminate the possibility of division by zero, and hence ensure that the controller in Eq. 13 is feasible, the user-defined parameters must be selected such that $-eg_e\, \mathcal{U}_{nom} + K_u(e) + K_M(e^2 - \Delta_d^2) < 0$ when $eg_e = 0$. Since $eg_e = 0$ only when e=0, the user-selected parameters must be designed such that:

$$K_1 < K_M \Delta_d^2 \quad \text{Eq. 14}$$

While the primary control objective as described herein is to restrict the rider's cadence within a user-defined range about a constant midpoint, a further control objective is an adaptive admittance control scheme for the control input $u_{nom}$ when the rider's cadence is within the desired cadence range (i.e., $e \in [-\Delta_d, \Delta_d]$). The admittance controller of example embodiments described herein is designed to indirectly track a desired torque. Hence, an interaction torque error $e_\tau$: $\mathbb{R}_{\geq 0} \rightarrow \mathbb{R}$ is defined as:

$$e_\tau \triangleq \tau_{int} - \tau_d \quad \text{Eq. 15}$$

where $\tau_d$: $\mathbb{R}_{\geq 0} \rightarrow \mathbb{R}$ and $\tau_{int}$: $\mathbb{R}_{\geq 0} \rightarrow \mathbb{R}$ denote the desired interaction torque and the measurable interaction torque between the cycle and rider, respectively. Further, it can be assumed that the interaction torque $\tau_{int}$ is bounded, i.e., $\tau_{int} \in \mathcal{L}_\infty$. An admittance filter is implemented to relate the interaction torque error to an admitted trajectory, which can be tracked using an inner-loop position controller.

DMD leads to progressive muscle degeneration and severe weakness, and some participants may not be capable of independently producing the required interaction torque to move the pedals and cycle. As such, embodiments described herein implement an admittance control scheme. The admittance filter can mimic a more compliant system by decreasing the parameters $M_d$ and $B_d$. Regardless of the current state of the system (i.e., q and $\dot{q}$), the admittance trajectory will be determined based on a desired system. The parameters of which are set by $M_d$ and $B_d$. Decreasing the desired inertia $M_d$ and the desired damping $B_d$ is analogous to reducing the weight and stiffness of the system, respectively. Hence, the admittance filter parameters can be adjusted to mimic an increasingly stiff or more compliant system to meet the participant's current functional capabilities. This provides significant flexibility in the rehabilitative efforts provided to the participant. The admittance filter of embodiments described herein is designed as:

$$e_\tau \triangleq M_d \ddot{q}_a + B_d \dot{q}_a \quad \text{Eq. 16}$$

where $q_a$, $\dot{q}_a$, $\ddot{q}_a$: $\mathbb{R}_{\geq 0} \rightarrow \mathbb{R}$ denote the admitted position, velocity, and acceleration, respectively, $M_d \in \mathbb{R}_{>0}$ denotes the desired inertia, and $B_d \in \mathbb{R}_{>0}$ denotes the desired damping. The parameters $M_d$ and $B_d$ are selected such that the transfer function of Eq. 16 is passive to ensure boundedness of the admitted trajectory (i.e., $q_a \in \mathcal{L}_\infty$).

The admittance trajectory only evolves if there is a non-zero value on the left-hand side of Eq. 16 (i.e., $e_\tau \neq 0$). Therefore, if the rider is able exactly generate the desired torque, the motor will not assist or resist the rider. If the rider falls short of the desired interaction torque, the motor will assist. Conversely, if the rider exceeds the desired interaction torque, the motor will resist the rider as needed. To track the admitted trajectory, an inner-loop position controller is provided herein. To quantify the admittance tracking control objective, the admittance position error $\xi: \mathbb{R}_{\geq 0} \to \mathbb{R}$ and auxiliary filtered tracking error $\psi: \mathbb{R}_{\geq 0} \to \mathbb{R}$ are defined as:

$$\xi \triangleq q_a - q \qquad \text{Eq. 17}$$

$$\psi \triangleq \dot{\xi} + \beta\xi \qquad \text{Eq. 18}$$

where $\beta \in \mathbb{R}_{>0}$ denotes a constant user-selected control parameter.

To facilitate the subsequent control development, $Y: \mathbb{R}_{\geq 0} \to \mathbb{R}^{1\times 8}$ and $\theta: \mathbb{R}_{\geq 0} \to \mathbb{R}^{8\times 1}$ denote a known regression matrix and a matrix of unknown constant system parameters, respectively, defined as:

$$Y\theta \triangleq M(\ddot{q}_a + \beta\psi - \beta^2\xi) + G + \frac{1}{2}\dot{M}(\dot{q}_a + \beta\xi) + b_c(\dot{q}_a - \psi + \beta\xi) \qquad \text{Eq. 19}$$

Taking the time derivative of the auxiliary admittance error in Eq. 18, pre-multiplying by M(q), substituting in Eq. 1, Eq. 2, Eq. 17, and Eq. 19, and adding and subtracting the admittance position error $\xi$ yields the open loop error system:

$$M\dot{\psi} = Y\theta + \chi - \frac{1}{2}\dot{M}\psi - \xi - g_e u_e \qquad \text{Eq. 20}$$

where the lumped control term $x: \mathcal{Q} \times \mathbb{R} \times \mathbb{R} \to \mathbb{R}$ is defined as $\chi \triangleq P + \tau_d - \tau_{vol} + \xi$ and can be bounded by Property 5 and Assumptions 1 and 2 as $|x| \leq c_1 + c_2\|\phi\|$, where $\phi \triangleq [\xi, \psi, \dot{q}_a]$ and $c_1, c_2 \in \mathbb{R}_{>0}$.

Based on the stability analysis, the adaptive admittance controller is designed as:

$$u_{nom} \triangleq \frac{1}{g_e}\left(Y\hat{\theta} + k_1\psi + (k_2 + k_3\|\phi\|)\mathrm{sgn}(\psi)\right) \qquad \text{Eq. 21}$$

where $k_1, k_2, k_3 \in \mathbb{R}_{>0}$ are positive user-defined gains, and $\hat{\theta}: \mathbb{R}_{\geq 0} \to \mathbb{R}^{8\times 1}$ denotes a time-varying estimate of the system parameters. Based on the subsequent stability analysis, the system parameter estimate update law is defined as:

$$\dot{\hat{\theta}} \triangleq \mathrm{proj}(\Gamma Y^T \psi) \qquad \text{Eq. 22}$$

where proj(·) denotes the projection algorithm and $\Gamma \in \mathbb{R}^{8\times 8}$ denotes a positive definite control gain matrix. Substituting Eq. 21 into Eq. 20 yields the closed loop error system:

$$M\dot{\psi} = Y\tilde{\theta} + \chi - \frac{1}{2}\dot{M}\psi - \xi - k_1\psi - (k_2 + k_3\|\phi\|\mathrm{sgn}(\psi)) \qquad \text{Eq. 23}$$

where $\tilde{\theta}: \mathbb{R}_{\geq 0} \to \mathbb{R}^{8\times 1}$ denotes the parametric estimation error and is defined as $\tilde{\theta} \triangleq \theta - \hat{\theta}$.

In an example embodiment in which the motor-actuated system modeled by the differential equation $\dot{z} = h(z)$, where $h(z \triangleq (\dot{q}, \ddot{q})$, the set $C \triangleq \{z \in \mathcal{Q} \times \mathbb{R}: |\dot{q}| \leq c_q\}$ denotes a set of physically realistic initial conditions, where $c_q \subset \mathbb{R}$ denotes some constant selected such that $\mathbb{S} \subset C$. The motor control input $u^*_e$ is locally Lipschitz, and the safe set $\mathbb{S}$ is USGAS provided the sufficient gain conditions in Eq. 9 and Eq. 14 are met. Further, the set C is invariant. To demonstrate this, $z: \mathcal{Q} \times \mathbb{R} \to \mathbb{R}^2$ is used to denote a solution to the differential equation $\dot{z} = h(z)$, with $z(0) \in C$. From the definition of UGAS, it is concluded that $$\lim_{t\to\infty} |e(t)|_{\mathbb{S}} = 0$$

for all $q \in \mathcal{Q}$ and $t \in \mathbb{R}_{\geq 0}$. This, and since $\mathbb{S} \subset C$ implies if $e(0) \in C$, then $e(t) \in C$ for all $t \in \mathbb{R}_{\geq 0}$, i.e., the set C is forward invariant.

According to a system modeled by the dynamics above, with Properties 1-6 and Assumption 1-2, $\{t_n^i\}$, $\forall i \in \{s, u\}$, $n \in \{0,1,2, \ldots\}$ represents the n-th time that $\dot{q}$ enters (denoted by i=s) and leaves (denoted by i=u) the region $\dot{q} \in [\dot{q}_d - \Delta_d, \dot{q}_d + \Delta_d]$. The motor control input in Eq. 21 and the adaptive update law in Eq. 22 ensure the closed-loop error system in Eq. 23 yields global asymptotic admittance tracking in the sense that $$\lim_{t\to\infty} |\xi(t)| = 0 \text{ and } \lim_{t\to\infty} |\psi(t)| = 0,$$

for all $q \in \mathcal{Q}$ and $t \in [t_n^s, t_n^u]$, provided the following sufficient gain conditions are satisfied: $k_1 > 0$, $k_2 > c_1$, $k_3 > c_2$. To demonstrate this, a candidate common Lyapunov-like function $V_L: \mathbb{R}^{10} \times \mathbb{R}_{\geq 0} \to \mathbb{R}$ is defined as:

$$V_L(z, t) \triangleq \frac{1}{2}\xi^2 + \frac{1}{2}M\psi^2 + \frac{1}{2}\tilde{\theta}^T\Gamma^{-1}\tilde{\theta} \qquad \text{Eq. 24}$$

where $z: \mathbb{R}_{\geq 0} \to \mathbb{R}^{10}$ is defined as $z \triangleq [\xi, \psi, \tilde{\theta}^T]^T$. Taking the time derivative of Eq. 24 yields:

$$\dot{V}_L \leq \xi\dot{\xi} + M\psi\dot{\psi} + \frac{1}{2}\dot{M}\psi^2 + \tilde{\theta}^T\Gamma^{-1}\dot{\tilde{\theta}} \qquad \text{Eq. 25}$$

Substituting Eq. 22 and Eq. 23 into Eq. 25 and canceling like terms yields:

$$\dot{V}_L = \psi(x - \xi - k_1\psi - (k_2 + k_3\|\phi\|)\mathrm{sgn}(\psi)) - \beta\xi^2 \qquad \text{Eq. 26}$$

By Properties 1-5, Assumptions 1-2, and $|\chi| \leq c_1 + c_2\|\phi\|$, Eq. 26 can be upper-bounded as:

$$\dot{V}_L \leq -\beta\xi^2 - k_1\psi^2 + |\psi|(c_1 + c_2\|\phi\|) - |\psi|(k_2 + k_3\|\phi\|) \qquad \text{Eq. 27}$$

Provided the sufficient gain conditions described above are satisfied, Eq. 27 can be further upper-bounded as:

$$\dot{V}_L \leq -\beta\xi^2 - k_1\psi^2 \qquad \text{Eq. 28}$$

Using Eq. 27, the time derivative of Eq. 24 can be upper-bounded as $\dot{V}_L \leq -\min\{\beta, k_1\}\|y\|^2$, where $y \triangleq [\xi, \psi]^T$ denotes a concatenated state vector. Using Eq. 24 and the fact that $\dot{V}_L \leq 0$ for all $q \in \mathcal{Q}$ implies $\xi, \psi, \tilde{\theta} \in \mathcal{L}_\infty$ and hence $\hat{\theta} \in \mathcal{L}_\infty$. The fact that $q_a, \xi, \psi, \in \mathcal{L}_\infty$ implies $q, \dot{\xi} \in \mathcal{L}_\infty$. This along with $\dot{q}_a \in \mathcal{L}_\infty$ implies $\dot{q} \in \mathcal{L}_\infty$. Using Eq. 21, $Y, \hat{\theta}, q, \dot{q}, \xi, \psi \in \mathcal{L}_\infty$ implies $u_e \in \mathcal{L}_\infty$. Therefore, the control unit input $u_e$ is bounded. From Eq. 22, $\dot{\hat{\theta}}$ is a function of Y and $\xi$. Since Y, $\xi \in \mathcal{L}_\infty$, then $\dot{\hat{\theta}} \in \mathcal{L}_\infty$. Using the LaSalle-Yoshizawa theorem, it can be concluded that $$\lim_{t\to\infty}|\xi(t)| = 0 \text{ and } \lim_{t\to\infty}|\psi(t)| = 0,$$

for all $q \in \mathcal{Q}$ and $t \in [t_n^s, t_n^u]$.

According to an example embodiment, a participant is secured to a seat of the recumbent cycle with the rehabilitation robot 100 positioned to avoid hyper extension of the participant's knee during pedaling. The participant of an example use case is instructed to cycle about a setpoint of 60 revolutions per minute (RPM). The safe set boundary for the controllers of the use case is encoded by $\Delta_d$=15 RPM. The rider being shown a real-time plot of their cadence featuring a visible indication of the set boundaries. The use case begins with a transient phase where a constant motor input assists the participant to bring their cadence up to the setpoint. After the initial ramp, the controllers are switched on and errors recorded. The transient portion of the operation is excluded from post processing to ensure that the presented data represents steady state operations. The control gains of the example use case in Eq. 9 being defined as $K_1$=0.8, $K_2$=0.8, $K_3$=0.25, and $K_M$=1 for both controllers. The admittance parameters selected as $M_d$=6 Nm·s$^2$/rad, $B_d$=0.1 Nm·s$^2$/rad, and $\tau_d$=0.2 N·m. The control gains in Eq. 18, Eq. 21, and Eq. 22 are selected as $k_1$=1.2, $k_2$=0.4, $k_3$=0.001, $\beta$=0.1, and $\Gamma=0.002\cdot 1_{8\times 8}$, where $1_{8\times 8}$ denotes the identity matrix.

Figure 2:
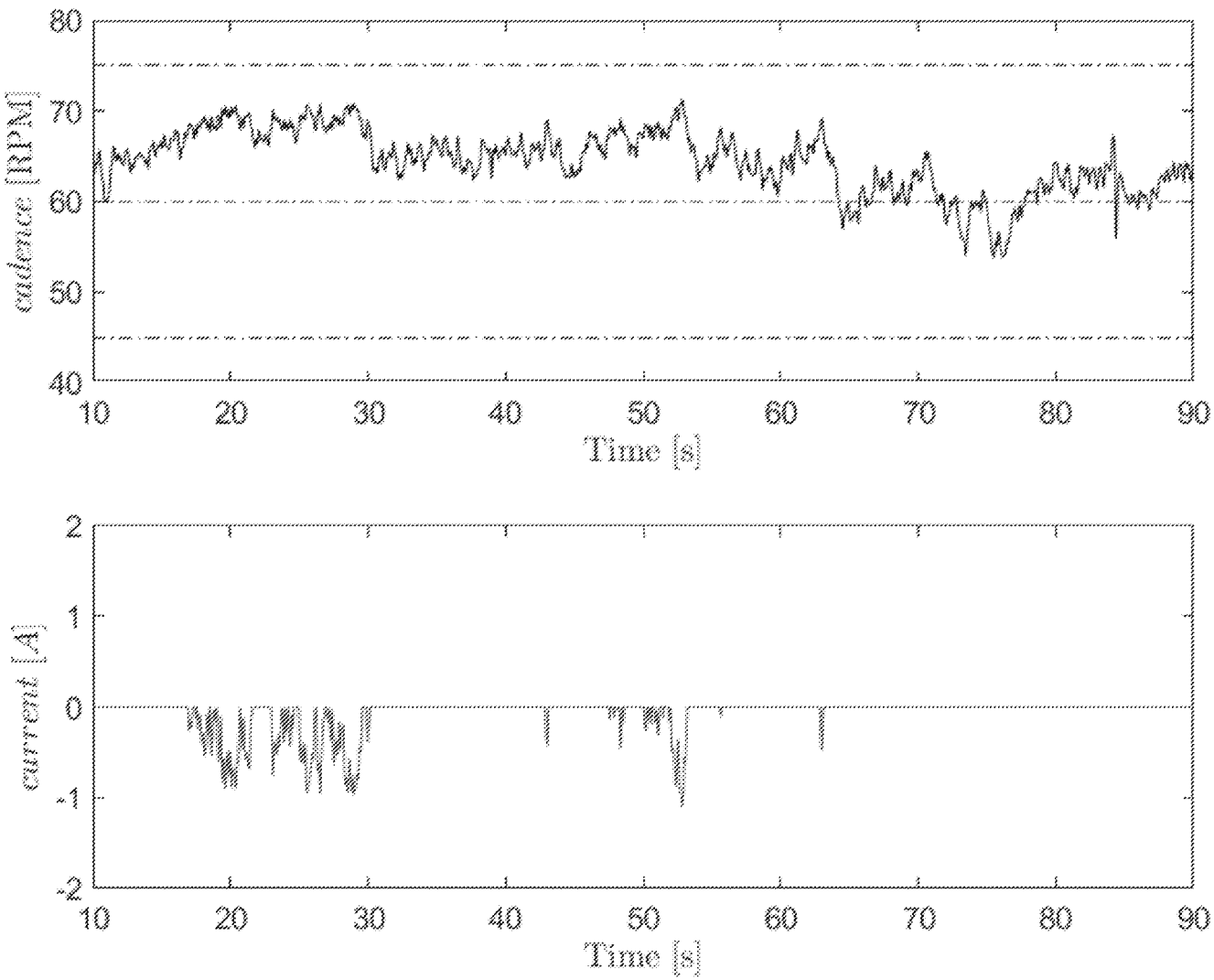
FIG. 2 illustrates the progression of the desired versus actual cadence and the motor input over the duration of the use case session using a given controller according to an example embodiment of the present disclosure.

In the example use case described above, FIG. 2 illustrates the progression of the desired versus actual cadence and the motor input over the duration of the use case session using a given controller. The controller of the use case example includes a root mean squared cadence error (RMSE) of 4.380 RPM and an average rider cadence of 64.510+/−3.406 RPM, when $\Delta_d$=15 RPM, suggesting that the cadence remained within the safe set. The average measured torque within the safe set was 0.259+/−0.205 Nm. The participant's cadence approaches the upper bound of the safe region at multiple instances during the session, and the motor resists the participant in response. For example, between approximately 16 and 28 seconds, the participant's cadence approaches the upper bounds of the safe region, and the resulting motor effort drives the participant's cadence back toward the desired setpoint. Throughout the majority of the session, the participant avoids the bounds of the safe region and hence has to rely solely on their own volitional pedaling.

Figure 3:
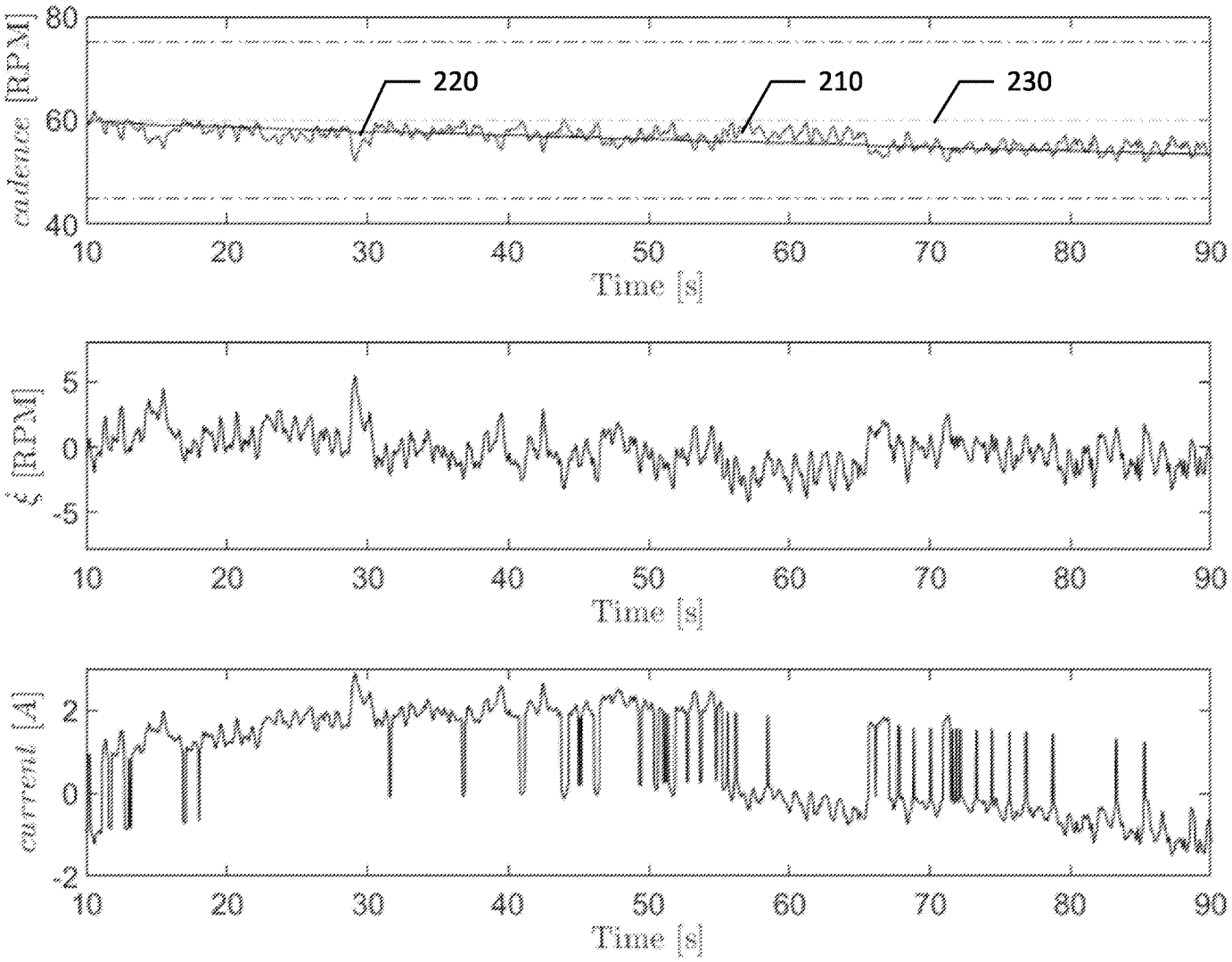
FIG. 3 illustrates the admitted versus actual cadence, the derivative of the admittance error, and the motor input of the example use case according to an example embodiment of the present disclosure.

FIG. 3 illustrates the admitted versus actual cadence, the derivative of the admittance error, and the motor input of the example use case described herein. The actual cadence is shown at 210, the admitted cadence at 220, and the desired cadence 230. The average cadence was 56.647+/−1.838 RPM for $\Delta_d$=15 RPM suggesting that the participant's cadence remained within the safe set. For the duration of the session, the controller had an admitted MRSE of 1.482 RPM and an average admitted cadence error of −0.216+/−1.458 RPM. The average interaction torque for the duration of the session was 0.201+/−0.228 Nm, which is within 3.84% of the desired torque, suggesting that the controller was able to adjust the range of measured interaction torque toward the desired value. As illustrated in the second plot of FIG. 3, the participant's cadence tracks the variable admitted trajectory while within the safe region. For the duration of the session, the admitted trajectory varied between roughly 48 and 60 RPM. Despite the variable admittance trajectory, the controller resulted in improved tracking performance of its control objected within the safe region compared to the session of FIG. 2. For both sessions and the controllers thereof, the CBF control scheme was able to restrict the cadence of the rider within the safe set.

Figure 4:
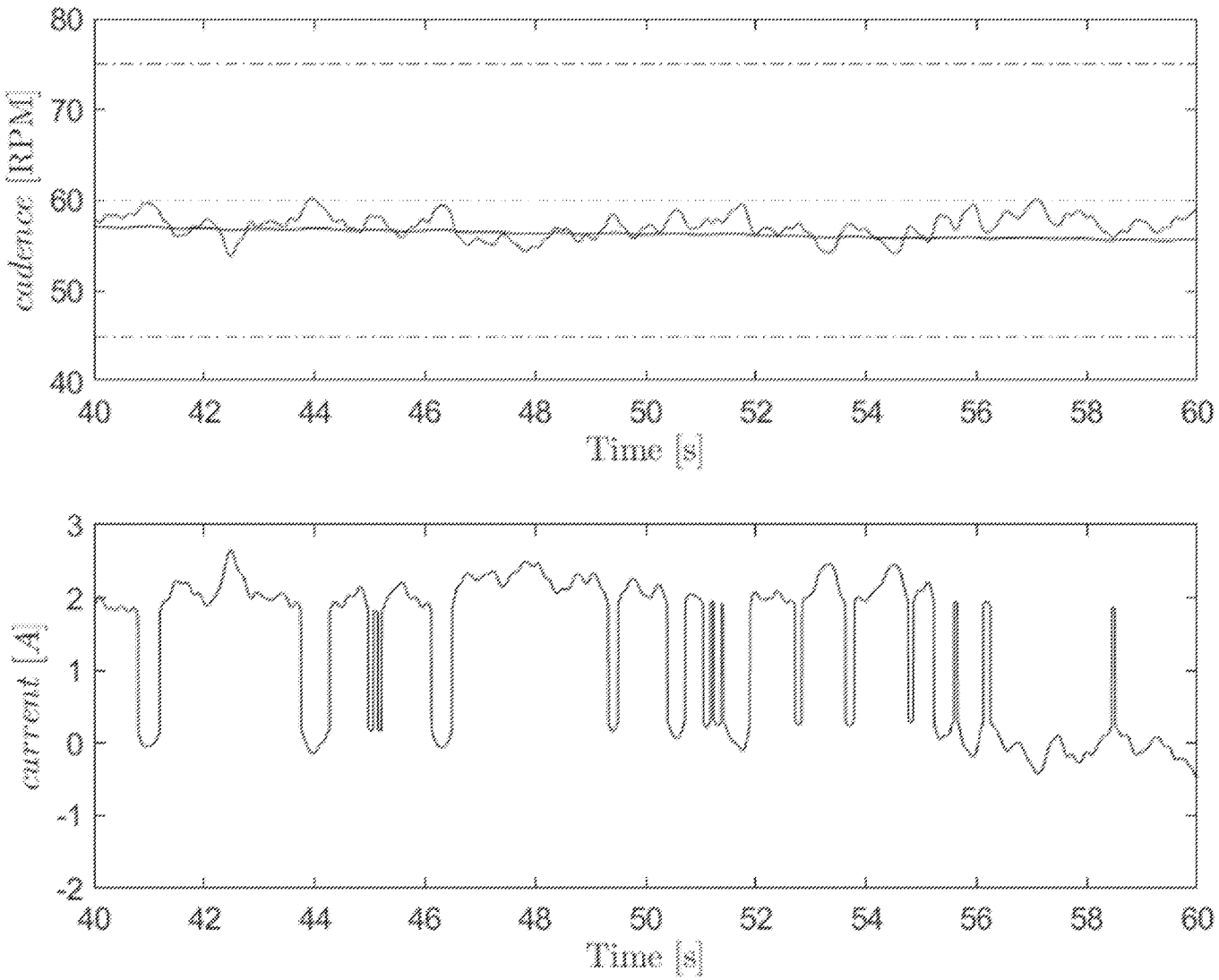
FIG. 4 illustrates the admitted versus actual cadence and the motor input of a controller for a twenty second time period according to an example embodiment of the present disclosure.

FIG. 4 illustrates the admitted versus actual cadence and the motor input of a controller for a twenty second time period. As volitional pedaling overcomes the desired torque (e.g., when the participant's cadence is greater than the admitted trajectory), the motor resists the rider. Conversely, as the torque produced by the rider undershoots the desired interaction torque, the motor input assists. Although the tracking objective of the controller operates at a slower cadence than the setpoint $\dot{q}_d$, the participant's cadence remains within the desired range. Moreover, the implementation of the admittance tracking objective enforced a selectable level of effort from the rider within the safe region. The controller of the session of FIG. 2 successfully enforces the desired cadence range on the rider, but it does not ensure the amount of effort the rider must provide within that range. In comparison, the addition of the admittance control scheme in Eq. 21 both enforces volitional effort of the participant within the desired cadence range and provides added flexibility in the rehabilitative efforts provided to the participant through the admittance filter parameters.

Embodiments provided herein include a motor-assisted stationary cycle for at-home rehabilitation for people with DMD. Embodiments provide a closed-loop adaptive admittance controller for the motor input. Moreover, a CBF is provided to promote a safe cycling system and encourage volitional pedaling by constraining the cadence of the rider within a user-defined, desired rehabilitative range. A Lyapunov-like stability analysis is used to ensure both UGAS of the safe set and global asymptotic tracking of the admittance errors. Embodiments are effective and provide rehabilitative therapy in a manner not previously available.

The developed control scheme restricts the participant's cadence $\dot{q}$ within a user-defined range about a desired set point $\dot{q}_d$. The participant's cadence is restricted within the bounds $\dot{q}_d-\Delta_d$ and $\dot{q}_d+\Delta_d$. While within this region, the participant tracks an admittance trajectory. The admittance trajectory allows for indirect torque tracking of a desired torque $\tau_d$ through the use of an admittance filter. Indirect torque tracking and the admittance filter enables embodiments described herein to mimic a more compliant system based on the parameters of the admittance filter. When the participant's cadence approaches the boundaries of the defined cadence range, the motor assists or resists the participant as necessary to maintain the participant's cadence within the desired range. FIG. 5 illustrates an algorithm for pseudocode of a control scheme according to an example embodiment of the present disclosure.

Figure 6:
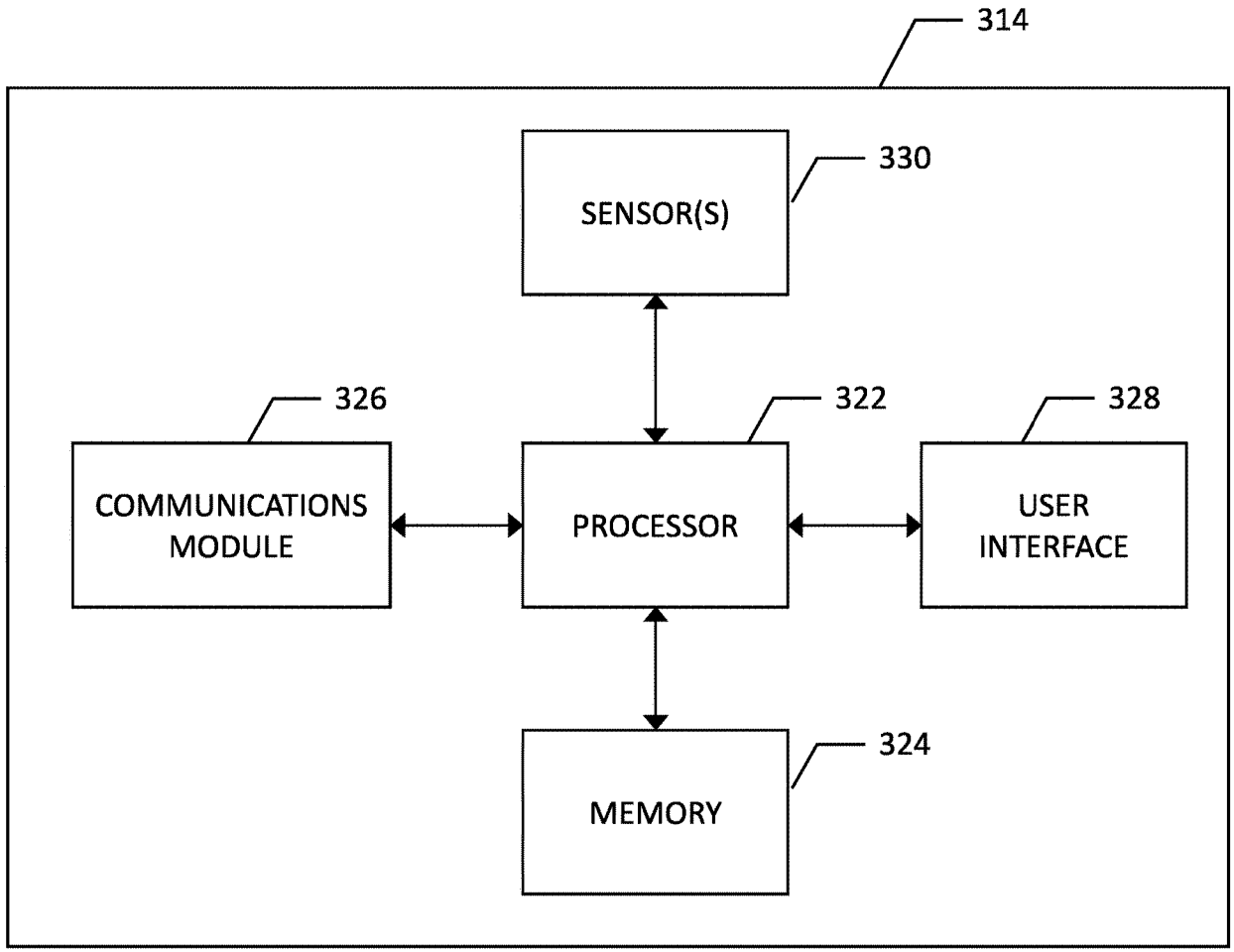
FIG. 6 is a schematic diagram of an example of a controller according to an example embodiment of the present disclosure.

As described above, embodiments provided herein include a controller 314 developed for a motor-assisted stationary cycle for at-home rehabilitation for people with DMD. FIG. 6 is a schematic diagram of an example of a controller 314 that may be implemented to provide control of the rehabilitation robot 100 of the recumbent cycling system described herein. The controller 314 may include or otherwise be in communication with a processor 322, a memory device 324, a communications module 326 and a user interface 328. As such, in some embodiments, although devices or elements are shown as being in communication with each other, hereinafter such devices or elements should be considered to be capable of being embodied within the same device or element and thus, devices or elements shown in communication should be understood to alternatively be portions of the same device or element.

In some embodiments, the processor 322 (and/or co-processors or any other processing circuitry assisting or otherwise associated with the processor) may be in communication with the memory device 324 via a bus for passing information among components of the apparatus. The memory device 324 may include, for example, one or more volatile and/or non-volatile memories. In other words, for example, the memory device 324 may be an electronic storage device (e.g., a computer readable storage medium) comprising gates configured to store data (e.g., bits) that may be retrievable by a machine (e.g., a computing device like the processor). For example, the memory device 324 could be configured to buffer input data for processing by the processor 322. Additionally or alternatively, the memory device could be configured to store instructions for execution by the processor.

The processor 322 may be embodied in a number of different ways. For example, the processor 322 may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor 322 may include one or more processors configured in tandem via the bus to enable independent execution of instructions, pipelining and/or multithreading. The processor may be embodied as a microcontroller having custom bootloader protection for the firmware from malicious modification in addition to allowing for potential firmware updates.

In an example embodiment, the processor 322 may be configured to execute instructions stored in the memory device 324 or otherwise accessible to the processor 322. Alternatively or additionally, the processor 322 may be configured to execute hard coded functionality. As such, whether configured by hardware or software methods, or by a combination thereof, the processor 322 may represent an entity (e.g., physically embodied in circuitry) capable of performing operations according to an embodiment of the present invention while configured accordingly. Thus, for example, when the processor 322 is embodied as an ASIC, FPGA or the like, the processor 322 may be specifically configured hardware for conducting the operations described herein. Alternatively, as another example, when the processor 322 is embodied as an executor of software instructions, the instructions may specifically configure the processor 322 to perform the algorithms and/or operations described herein when the instructions are executed. However, in some cases, the processor 322 may be a processor of a specific device configured to employ an embodiment of the present invention by further configuration of the processor 322 by instructions for performing the algorithms and/or operations described herein. The processor 322 may include, among other things, a clock, an arithmetic logic unit (ALU) and logic gates configured to support operation of the processor 322. In one embodiment, the processor 322 may also include user interface circuitry configured to control at least some functions of one or more elements of the user interface 328.

The communications module 326 may include various components, such as a device or circuitry embodied in either hardware or a combination of hardware and software that is configured to receive and/or transmit data for communicating data between a physical therapist and a participant which can facilitate teleoperation of the system as described herein. In this regard, the communications module 326 may include, for example, an antenna (or multiple antennas) and supporting hardware and/or software for enabling communications wirelessly. Additionally or alternatively, the communications module 326 may include the circuitry for interacting with the antenna(s) to cause transmission of signals via the antenna(s) or to handle receipt of signals received via the antenna(s). For example, the communications module 326 may be configured to communicate wirelessly such as via Wi-Fi (e.g., vehicular Wi-Fi standard 802.11p), Bluetooth, mobile communications standards (e.g., 3G, 4G, or 5G) or other wireless communications techniques. In some instances, the communications module 326 may alternatively or also support wired communication, which may communicate with a separate transmitting device (not shown). As such, for example, the communications module 326 may include a communication modem and/or other hardware/software for supporting communication via cable, digital subscriber line (DSL), universal serial bus (USB) or other mechanisms. For example, the communications module 326 may be configured to communicate via wired communication with other components of a computing device.

The user interface 328 may be in communication with the processor 322, such as the user interface circuitry, to receive an indication of a user input and/or to provide an audible, visual, mechanical, or other output to a user. As such, the user interface 328 may include, for example, one or more buttons, light-emitting diodes (LEDs), a display, a speaker, and/or other input/output mechanisms. The user interface 328 may also be in communication with the memory device 324 and/or the communications module 326, such as via a bus. The user interface 328 may include an interface with the cycle to provide the rehabilitative cycling through force feedback as described above.

The communications module 326 may facilitate communication between the master controller system 312, the FES muscle stimulation of the legs 316, and the leg-cycle crank shaft 318. Further, the communications module may facilitate communication from the master controller and leg-cycle systems to a rehabilitation therapist so the therapist can see and at least partially control the functionality of the cycle systems. The communications module 326 may be capable of operating in accordance with various first generation (1G), second generation (2G), 2.5G, third-generation (3G) communication protocols, fourth-generation (4G) communication protocols, fifth-generation (5G) communication protocols, Internet Protocol Multimedia Subsystem (IMS) communication protocols (e.g., session initiation protocol (SIP)), and/or the like. For example, a mobile terminal may be capable of operating in accordance with 2G wireless communication protocols IS-136 (Time Division Multiple Access (TDMA)), Global System for Mobile communications (GSM), IS-95 (Code Division Multiple Access (CDMA)), and/or the like. Also, for example, the mobile terminal may be capable of operating in accordance with 2.5G wireless communication protocols General Packet Radio Service (GPRS), Enhanced Data GSM Environment (EDGE), and/or the like. Further, for example, the mobile terminal may be capable of operating in accordance with 3G wireless communication protocols such as Universal Mobile Telecommunications System (UMTS), Code Division Multiple Access 2000 (CDMA2000), Wideband Code Division Multiple Access (WCDMA), Time Division-Synchronous Code Division Multiple Access (TD-SCDMA), and/or the like.

The controller may optionally include or be connected to one or more sensors 330, such as a torque sensor, cycling rate/cadence sensor (e.g., encoder), a heart rate sensor, a body temperature sensor, or other physiological sensors that may sense information relating to the condition of an operator of the cycling systems.

Figure 7:
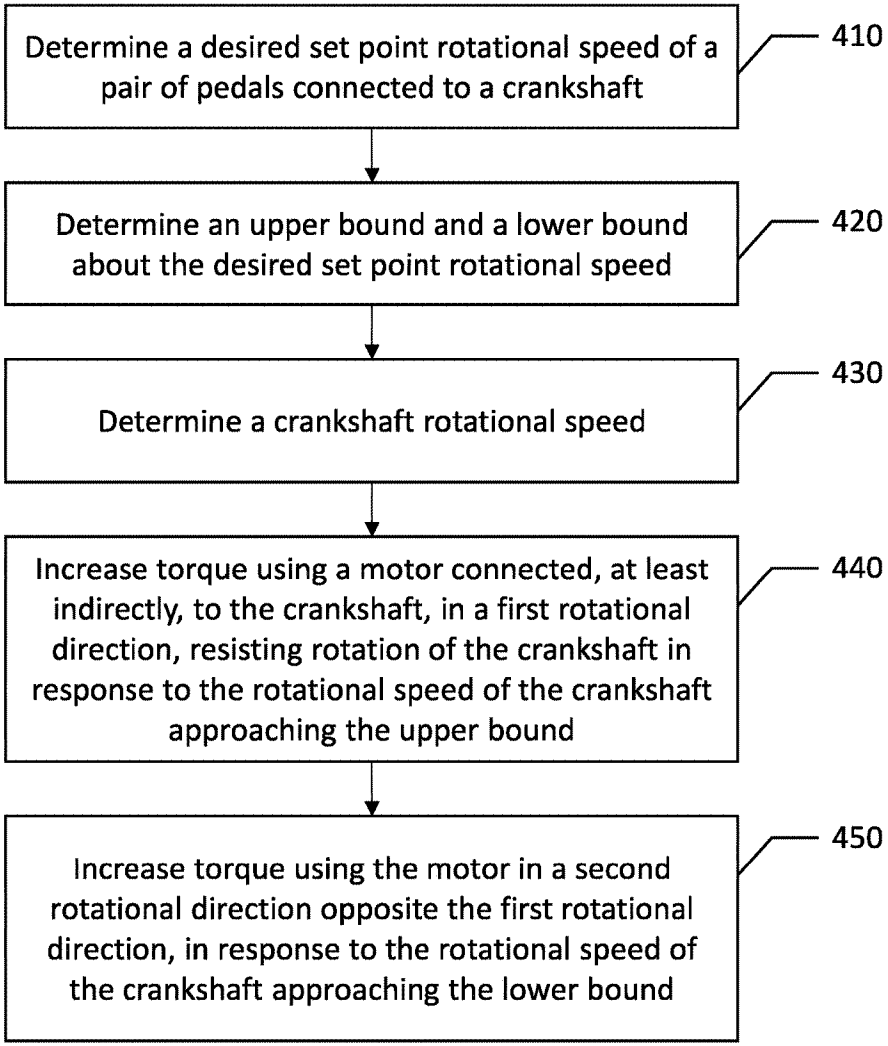
FIG. 7 is a flowchart of a method for operation of a motor-assisted stationary rehabilitation cycle employing a closed-loop control scheme according to an example embodiment of the present disclosure.

FIG. 7 illustrates a flowchart of a method according to an example embodiment of the disclosure. It will be understood that each block of the flowchart, and combinations of blocks in the flowchart, may be implemented by various means, such as hardware, firmware, processor, circuitry, and/or other devices associated with execution of software including one or more computer program instructions. For example, one or more of the procedures described above may be embodied by computer program instructions. In this regard, the computer program instructions which embody the procedures described above may be stored by the memory device 124 of an apparatus employing an embodiment of the present invention and executed by the processor 122 of the apparatus. As will be appreciated, any such computer program instructions may be loaded onto a computer or other programmable apparatus (e.g., hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowcharts support combinations of means for performing the specified functions and combinations of operations for performing the specified functions for performing the specified functions. It will also be understood that one or more blocks of the flowcharts, and combinations of blocks in the flowcharts, can be implemented by special purpose hardware-based computer systems which perform the specified functions, or combinations of special purpose hardware and computer instructions.

According to the flow chart of FIG. 7, a desired set point is determined for rotational speed of a pair of pedals connected to a crankshaft at 410. This desired set point may be identified by, for example, a therapist or physician of a participant. An upper bound and a lower bound about the desired set point rotational speed are set at 420. A crankshaft rotational speed is determined at 430. This rotational speed may be determined based on any conventional mechanism, such as a wheel encoder, a rotation counter, etc. At 440, torque is increased using a motor connected, at least indirectly, to the crankshaft in a first rotational direction, resisting rotation of the crankshaft in response to the rotational speed of the crankshaft approaching the upper bound. At 450, torque is increased using the motor in a second rotational direction, opposite the first rotational direction, in response to the rotational speed of the crankshaft approaching the lower bound.

In an example embodiment, an apparatus for performing the method of FIG. 7 above may comprise a processor (e.g., the processor 322) configured to perform some or each of the operations (410-450) described above. The processor may, for example, be configured to perform the operations (410-450) by performing hardware implemented logical functions, executing stored instructions, or executing algorithms for performing each of the operations. Alternatively, the apparatus may comprise means for performing each of the operations described above. In this regard, according to an example embodiment, examples of means for performing operations 410-450 may comprise, for example, the processor 322 and/or a device or circuit for executing instructions or executing an algorithm for processing information as described above.

In some embodiments, certain ones of the operations above may be modified or further amplified. Furthermore, in some embodiments, additional optional operations may be included. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A system for comprising:

a pair of pedals connected to a crankshaft via a pair of pedal arms;

a motor coupled directly or indirectly to the crankshaft; and a controller configured to operate using a closed-loop control scheme to control the motor, during steady-state operation, to track torque of a desired torque through use of an admittance filter and to increase torque in a first rotational direction, resisting rotation of the crankshaft in response to a rotational speed of the crankshaft approaching a first predefined rotational speed, and increase torque in a second rotational direction, opposite the first rotational direction in response to the rotational speed of the crankshaft approaching a second predefined rotational speed.

2. The system of claim 1, further comprising a display, wherein the display provides for display of the first predefined rotational speed, the second predefined rotational speed, and the rotational speed of the crankshaft.

3. The system of claim 1, wherein the controller implements a control barrier function to increase torque in the first rotational direction, resisting rotation of the crankshaft in response to the rotational speed of the crankshaft approaching the first predefined rotational speed, and increase torque in the second rotational direction, opposite the first rotational direction of in response to the rotational speed of the crankshaft approaching the second predefined rotational speed.

4. The system of claim 1, wherein the controller is configured to encourage volitional pedaling by constraining a cadence of a participant operating the pair of pedals by constraining the rotational speed of the crankshaft between the first predefined rotational speed and the second predefined rotational speed.

5. The system of claim 1, further comprising a seat, wherein the seat is adjustable relative to the pair of pedals to accommodate participants of differing sizes.

6. The system of claim 5, wherein the pair of pedal arms extend between the crankshaft and the pair of pedals, wherein the pedal arms comprise an adjustable length to change a pedal stroke about the crankshaft.

7. The system of claim 1, wherein steady-state operation is achieved in response to the rotational speed of the crankshaft rising from zero to be above the second predefined rotational speed.

8. The system of claim 1, wherein a transient operation occurs before steady-state operation, and wherein during the transient operation, the controller is configured to control the motor to increase torque in the second rotational direction until the second predefined rotational speed is achieved.

9. The system of claim 1, wherein the controller is further configured to provide a control barrier function (CBF) configured to restrict a cadence of a rider within a user-defined cadence range and at least one of assist or resist the rider when the rotational speed of the crankshaft approaches boundaries of the user-defined cadence range to maintain the rotational speed of the crankshaft within the user-defined cadence range and enforce volitional effort of the rider within the user-defined cadence range.

10. The system of claim 9, wherein a Lyapunov-like stability analysis with the control barrier function (CBF) is used to ensure asymptotic tracking of admittance errors within the user-defined cadence range and uniform global asymptotic stability of a safe set.

11. A method comprising:

determining a desired set point rotational speed of a pair of pedals connected to a crankshaft;

determining an upper bound and a lower bound about the desired set point rotational speed;

determining a crankshaft rotational speed;

tracking torque of a desired torque through use of an admittance filter;

increasing torque using a closed-loop controller to operate a motor connected, at least indirectly, to the crankshaft in a first rotational direction, resisting rotation of the crankshaft in response to the crankshaft rotational speed approaching the upper bound; and increasing torque using the motor in a second rotational direction, opposite the first rotational direction in response to the crankshaft rotational approaching the lower bound.

12. The method of claim 11, further comprising:

providing for display of the desired set point rotational speed, the upper bound, the lower bound, and the crankshaft rotational speed.

13. The method of claim 11, further comprising: encouraging volitional pedaling by constraining a cadence of a participant operating a pair of pedals by constraining the crankshaft rotational speed between the upper bound and the lower bound.

14. The method of claim 11, further comprising:

providing a control barrier function (CBF) configured to restrict a cadence of a rider within a user-defined cadence range and at least one of assist or resist the rider when the crankshaft rotational speed approaches boundaries of the user-defined cadence range to maintain the crankshaft rotational speed within the user-defined cadence range and enforce volitional effort of the rider within the user-defined cadence range.

15. The method of claim 14, further comprising:

ensuring asymptotic tracking of admittance errors within the user-defined cadence range using a Lyapunov-like stability analysis with the control barrier function (CBF) and uniform global asymptotic stability of a safe set.

16. A controller configured to:

receive a desired set point rotational speed of a pair of pedals connected to a crankshaft;

receive an upper bound and a lower bound about the desired set point rotational speed;

determine a crankshaft rotational speed;

operating using a closed-loop control scheme to track torque received at the crankshaft through an admittance filter that adapts to functional abilities of each user;

increase torque using a motor connected, at least indirectly, to the crankshaft in a first rotational direction, resisting rotation of the crankshaft in response to the crankshaft rotational speed approaching the upper bound; and increase torque using the motor in a second rotational direction, opposite the first rotational direction in response to the crankshaft rotational speed approaching the lower bound.

17. The controller of claim 16, wherein the controller is further configured to provide for display of the desired set point rotational speed, the upper bound, the lower bound, and the crankshaft rotational speed.

18. The controller of claim 16, wherein the controller is further configured to provide a control barrier function (CBF) configured to restrict a cadence of a rider within a user-defined cadence range and at least one of assist or resist the rider when the crankshaft rotational speed approaches boundaries of the user-defined cadence range to maintain the crankshaft rotational speed within the user-defined cadence range and enforce volitional effort of the rider within the user-defined cadence range.

19. The controller of claim 18, wherein the controller is further configured to provide a Lyapunov-like stability analysis with the control barrier function (CBF) is used to ensure asymptotic tracking of admittance errors within the user-defined cadence range and uniform global asymptotic stability of a safe set.

* * * * *